US007748198B2

(12) United States Patent
Cere'

(10) Patent No.: US 7,748,198 B2
(45) Date of Patent: Jul. 6, 2010

(54) APPARATUS AND METHOD FOR APPLYING CORNER ELEMENTS TO PALLETIZED LOADS

(75) Inventor: Mauro Cere', Loiano (IT)

(73) Assignee: Aetna Group S.p.A., Rimini (IT)

( * ) Notice: Subject to any disclaimer, the term of this patent is extended or adjusted under 35 U.S.C. 154(b) by 0 days.

(21) Appl. No.: 11/961,082

(22) Filed: Dec. 20, 2007

(65) Prior Publication Data

US 2008/0092486 A1 Apr. 24, 2008

Related U.S. Application Data

(62) Division of application No. 10/874,477, filed on Jun. 23, 2004, now Pat. No. 7,325,371.

(30) Foreign Application Priority Data

Jun. 27, 2003 (IT) ..... BO2003A0399
Nov. 14, 2003 (IT) ..... BO2003A0681

(51) Int. Cl.
*B65B 61/22* (2006.01)

(52) U.S. Cl. ..... 53/139.7; 53/410; 53/399; 53/587

(58) Field of Classification Search ..... 53/410, 53/139.6, 139.7, 399, 168, 587, 588
See application file for complete search history.

(56) References Cited

U.S. PATENT DOCUMENTS 3,378,987 A 4/1968 Lems
4,897,980 A 2/1990 Geyser et al.
5,226,280 A 7/1993 Scherer et al.
5,535,572 A 7/1996 Morantz et al.
5,546,730 A 8/1996 Newell et al.
5,564,254 A 10/1996 Thimon et al.
5,758,470 A 6/1998 Lancaster, III
6,178,721 B1 1/2001 Turfan
6,508,044 B2 1/2003 Suolahti
6,883,293 B2 4/2005 Lancaster, III et al.
6,990,784 B2 * 1/2006 Lancaster et al. ..... 53/399
7,325,371 B2 * 2/2008 Cere' ..... 53/139.7
2003/0051439 A1 3/2003 Lancaster, III et al.

FOREIGN PATENT DOCUMENTS

EP 0 562 399 9/1993

OTHER PUBLICATIONS

European Search Report for European Application No. 04 42 5463; Oct. 19, 2004.

* cited by examiner

*Primary Examiner*—Hemant M Desai
(74) *Attorney, Agent, or Firm*—Fay Sharpe LLP

(57) ABSTRACT

Described is an apparatus and method for applying to a palletized load protective corner elements having first and second sides designed to protect contiguous sides of at least one corner of the load. The apparatus comprises a transfer system for conveying at least one corner element from an initial position to a position where the sides of the corner element are close to the corresponding edges of the corner to be protected, this transfer system comprising an actuating system for transferring the corner element by a rotational movement through predetermined angles α and β from the initial position to a position where at least a first side of the corner element is substantially aligned with a first side of the corner of the load.

15 Claims, 6 Drawing Sheets

APPARATUS AND METHOD FOR APPLYING CORNER ELEMENTS TO PALLETIZED LOADS

CROSS-REFERENCE TO RELATED APPLICATION

This application is a divisional of U.S. application Ser. No. 10/874,477 filed Jun. 23, 2004 now U.S. Pat. No. 7,325,371 issued on Feb. 5, 2008, which claims priority from Italian Application No. BO 2003A 000399 filed Jun. 27, 2003 and Italian Application No. BO 2003A 000681 filed Nov. 14, 2003. U.S. application Ser. No. 10/874,477 filed Jun. 23, 2004 is hereby expressly incorporated by reference.

BACKGROUND OF THE INVENTION

The present invention relates to an apparatus for applying protective corner elements to palletized loads.

In particular, the apparatus is designed for use with packaging machinery for wrapping palletized loads with plastic film.

At present, several systems for applying corner pieces to palletized loads are known. In these systems, a pickup device extracts a corner piece from a magazine and transfers it to the corner of the load to be protected.

This operation presents several problems, due to the difficulty, after extracting the corner piece from the magazine, of lining it up correctly according to the position of the load, transferring it and applying it accurately to the load, all within the shortest possible space of time.

In known solutions, the devices which transfer the corner piece from the magazine to the load usually comprise a pair of rails running alongside the load. The corner piece moves along the rails until it is stopped against the corner of the load.

The use of rails, however, exposes the load to a high risk of being damaged by impact with the edge of the incoming corner piece unless complicated means are used to control the angular movement of the corner piece.

SUMMARY OF THE INVENTION

The present invention therefore has for a primary aim to overcome the above mentioned difficulties by providing an apparatus and a method for applying corner elements to palletized loads where each corner element is transferred to the load principally in a single rotational movement.

Further aims of the invention are to provide a system for transferring the corner elements that is at once simple and fast and to permit use without making substantial modifications to palletized load wrapping machinery of different kinds, for example, machinery designed to wrap loads of different sizes or already equipped with corner element magazines.

In accordance with the invention, these aims are achieved by an apparatus and a method as defined in the main appended claims.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate preferred embodiments of the invention provided merely by way of example without restricting the scope of the inventive concept, and in which:

DESCRIPTION OF THE PREFERRED EMBODIMENTS

Described with reference to the accompanying drawings is an apparatus for applying protective corner elements to palletized loads.

The apparatus may be used in conjunction with machinery for wrapping palletized loads of various kinds with stretch film.

Figure 1:
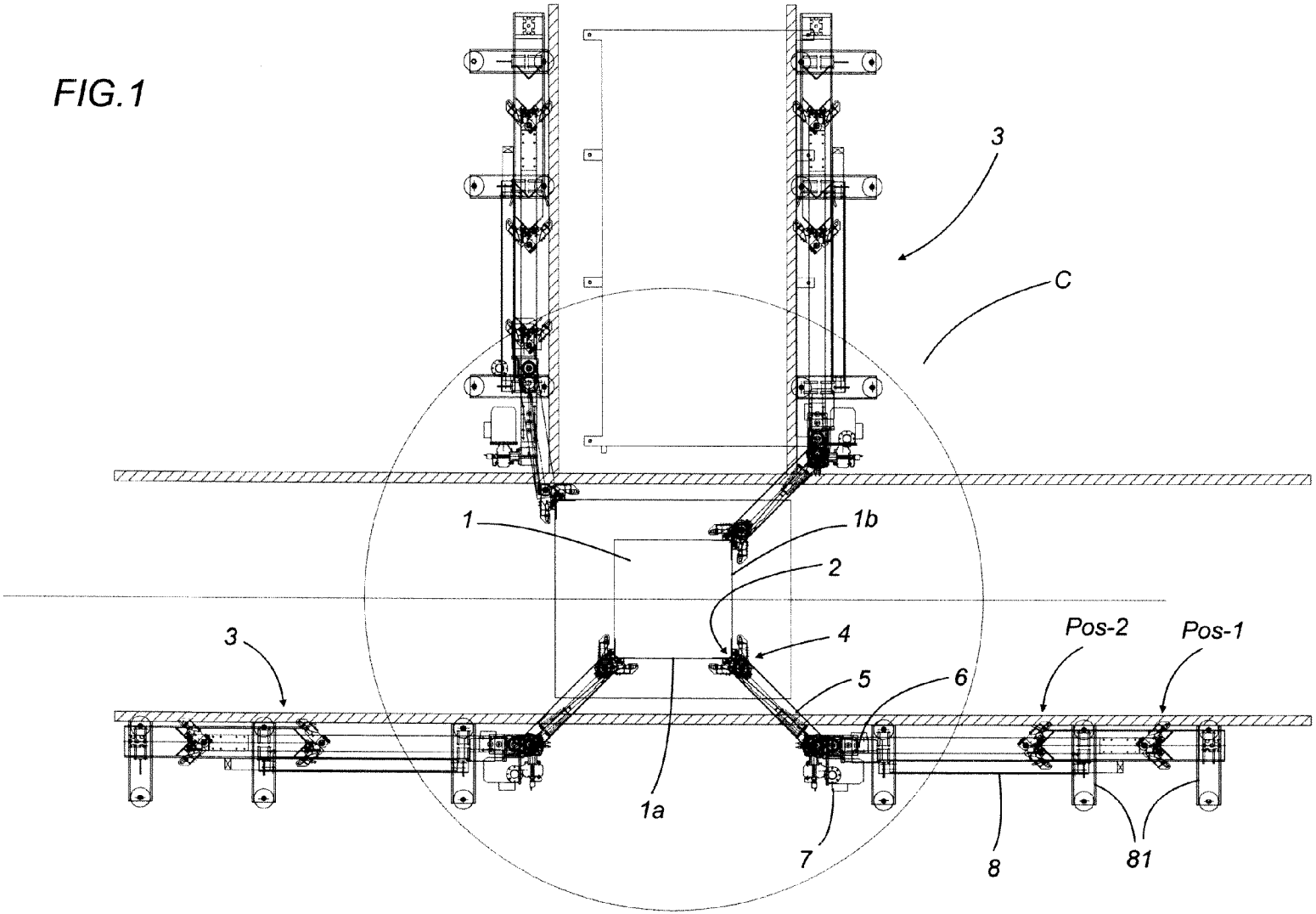
FIG. 1 is a top view of a machine for wrapping palletized loads equipped with four apparatuses according to the invention.

The reference to the machine shown in FIG. 1 is provided purely by way of non-restricting example.

FIG. 1 schematically illustrates a machine for wrapping palletized loads 1 with plastic film following a circular path C according to a method which is already known and therefore not further described herein.

Although FIG. 1 illustrates an example with four apparatuses according to the invention, one for each corner of the load 1 to be protected, it will be understood that the apparatus according to the invention is a self-contained module that may be used for one or more corners of the load 1.

According to the invention, an apparatus for applying protective corner elements 2 to a palletized load 1 comprises:

- a unit 4 for gripping a corner element 2;
- a transfer arm 5 mounting the unit 4 and designed to apply the corner element 2 to a corner of the load 1;
- a motor unit 6 for turning the arm 5.

The apparatus may further comprise:

- a magazine 3 containing corner elements 2 for feeding the transfer arm 5;
- another motor unit 7 for moving the arm 5 along a rail 8 positioned between the magazine 3 and the load 1;
- at least one unit 9 for extracting the corner elements 2 from a magazine 3.

Looking in more detail with reference to the preferred embodiment being described, the arm 5 has a swiveling end which is rotationally driven about a pin 51 by the motor unit 6 through a mechanism which is well known and therefore not described in further detail.

At its other end, the arm 5 mounts the gripping unit 4, which is in turn mounted on a pin 41 attached to the arm 5 so as to rotate with respect to the arm 5 itself.

Figures 3A, 3B:
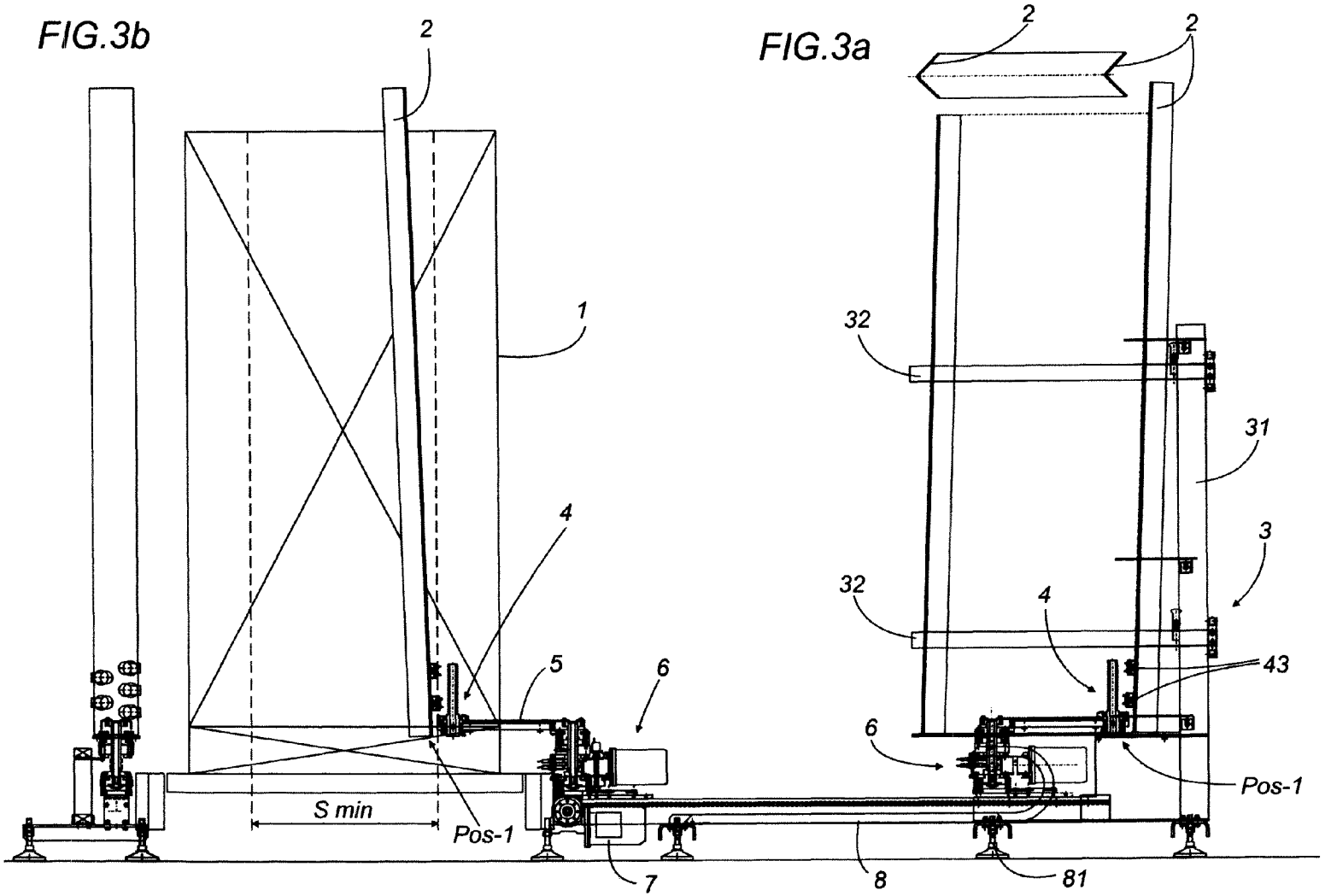
FIGS. 3*a* and 3*b* show the apparatus of FIG. 2 in the positions where the corner element is picked up from a magazine and where the corner element is applied to a load, respectively.

The arm 5, the motor unit 6 and the gripping unit 4 can also move in a straight line in both directions along the rail 8, mounted on the bases 81, and are driven by the motor unit 7 through a customary transmission mechanism, for example of the chain type, between a loading position inside the magazine 3 and a position of extraction from the magazine itself (FIGS. 3*a*, 3*b*).

Figure 2:
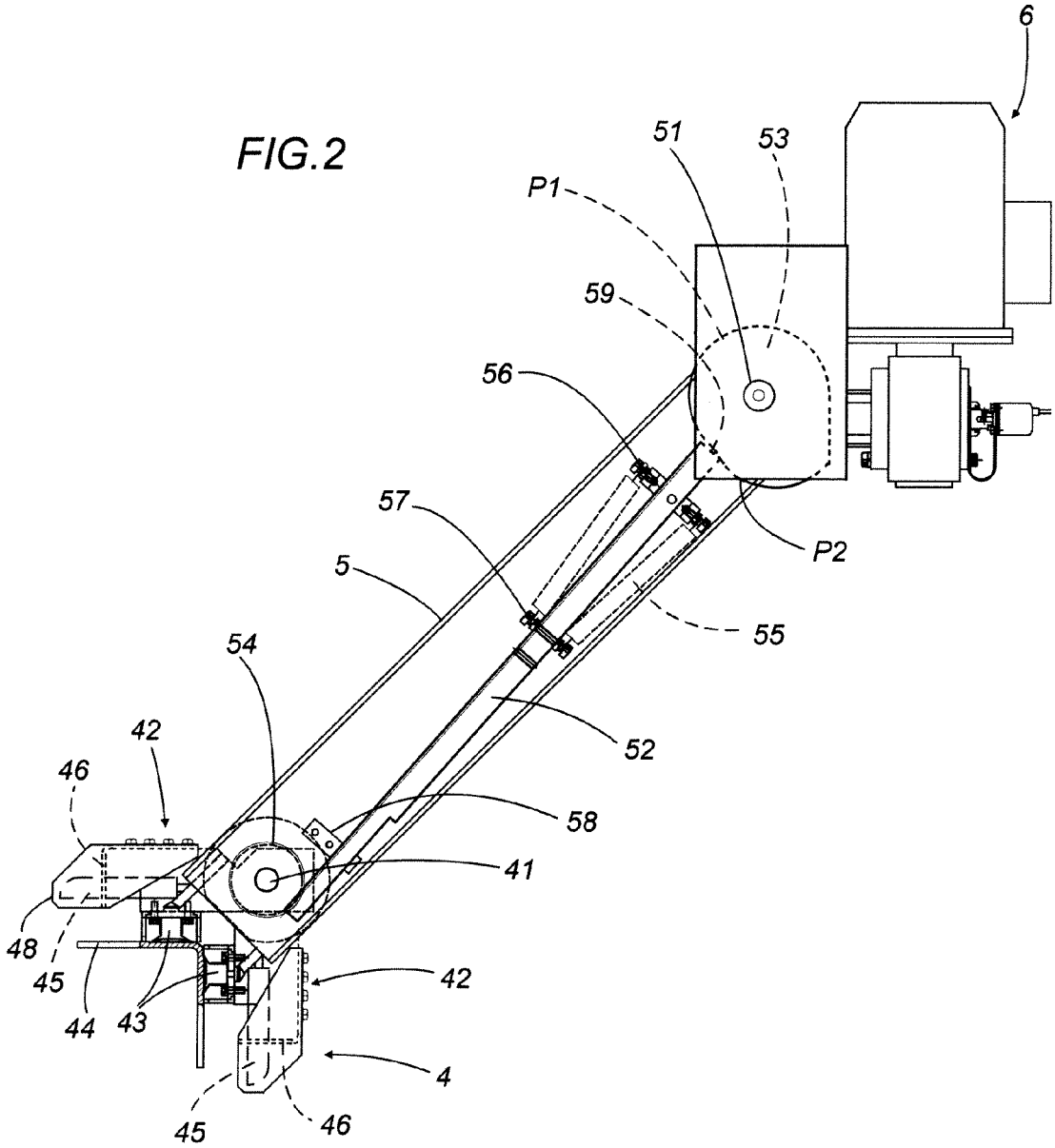
FIG. 2 illustrates a detail of the apparatus according to the invention.

With reference in particular to FIG. 2, the gripping unit 4 comprises a pair of gripping elements or fingers 42 consisting of plates 46 linked to the swivel pin 41 and preferably equipped with covers or guards 49.

The fingers 42 are also equipped with gripping means such as suction cups 43, for example, mounted at the sides of an L-shaped profile 44 extending vertically and fixed to the fingers 42.

Preferably, each side of the profile 44 mounts two or more vertically spaced suction cups 43 which communicate with the inside face of the profile 44 in such a way that they can come into contact with the corner element 2 being gripped, thus guaranteeing stability even in the case of very large corner elements (for example, corner elements up to 208 cm high and even higher).

Below is a description, with reference to FIGS. 3*a* and 3*b*, of a magazine 3 containing corner elements 2 and to be used in conjunction with the apparatus according to the invention, it being understood that the invention can also be used with other types of magazine.

In this embodiment, the magazine 3 comprises a vertical frame, mounted on the rail 8 and equipped with an upright 31. The latter has pairs of side containment arms 32 extending from it, preferably with their outer ends diverging, designed to hold a set of corner elements 2.

Advantageously, the magazine 3 allows the gripping element 4 to penetrate it in order to catch hold of the corner elements 2 to be transferred to the load 1.

Preferably, the walls of the magazine 3 diverge downwardly (for example by around 2°) with respect to the vertical. Thanks to this divergence, the corner elements are gripped and reach the load at an angle. Thus, each corner element approaches and comes into contact with the load 1 first with its upper end, which is clear of all parts of the apparatus and is ready to be wrapped by the plastic film in the subsequent packaging step.

According to the invention, the arm 5 is also equipped with a rack 52 which can slide inside it on guides 58.

The rack 52 is linked at one end 59 in such a way as to follow the profile of a fixed cam 53 positioned concentrically with the pin 51, and, at the other end of it, meshes with a toothed wheel 54 on which the swivel pin 41 of the gripping unit 4 is mounted.

Preferably, the connection between the cam and the rack consists of a sliding contact at the end of the rack 59 against the profile of the cam and held securely in place by traction springs 55 hooked to fixed points 56 on the arm 5 and to points 57 on the rack 52.

Any other type of suitable connection allowing the rack 52 to move in both directions may be used without departing from the scope of the invention.

Advantageously, during the rotational motion of the arm 5, the rack 52 and the toothed wheel 54 act as a mechanism for compensating the angular position adopted by the unit 4 according to the extent of rotation of the arm 5.

More specifically, with reference to the embodiment illustrated in FIG. 2, during a first neutral profile section P1 of the cam 53, the rack 52 remains inactive, and the unit 4 keeps its angular position relative to the arm 5.

Once in the positive ramp section P2, on the other hand, the rack 52 is actuated by the cam, slides lengthways relative to the arm 5 and causes the toothed wheel 54 to rotate, with the result that, while the arm 5 rotates relative to an external reference, driving the unit 4 along with it, the unit 4 itself performs an angular rotation, for example equal and opposite, relative to that of the arm 5, thus maintaining the angular position it had at the end of the first section P1.

For example, with reference to FIG. 1, the first section P1 corresponds to a rotation of 135° of the arm 5 from the position where the corner element 2 is picked up from the magazine 3 to the position where the arm 5 is aligned with the diagonal of the load 1 or, in other terms, to the rotation through 135° of the corner element 2 from the position where it is inside the magazine 3 to the position where it is parallel with the sides of the load 1.

The rotation of the arm 5 causes the corner element 2 held by the unit 4 to also rotate through 135° to the correct application position where the sides of the corner element are parallel with the corresponding sides of the load 1.

From this position, continuing the rotation of the arm 5 (which may rotate through a different angle, according to the size of the load to which the corner element is to be applied), the cam 53 enters the positive ramp section P2 so that the angular position of the unit 4 does not change and the sides of the corner element 2 remain parallel with the sides of the load 1.

Obviously, the cam profile may be different, provided always that it can compensate or vary the angular position of the gripping unit relative to the transfer arm.

Figure 4:
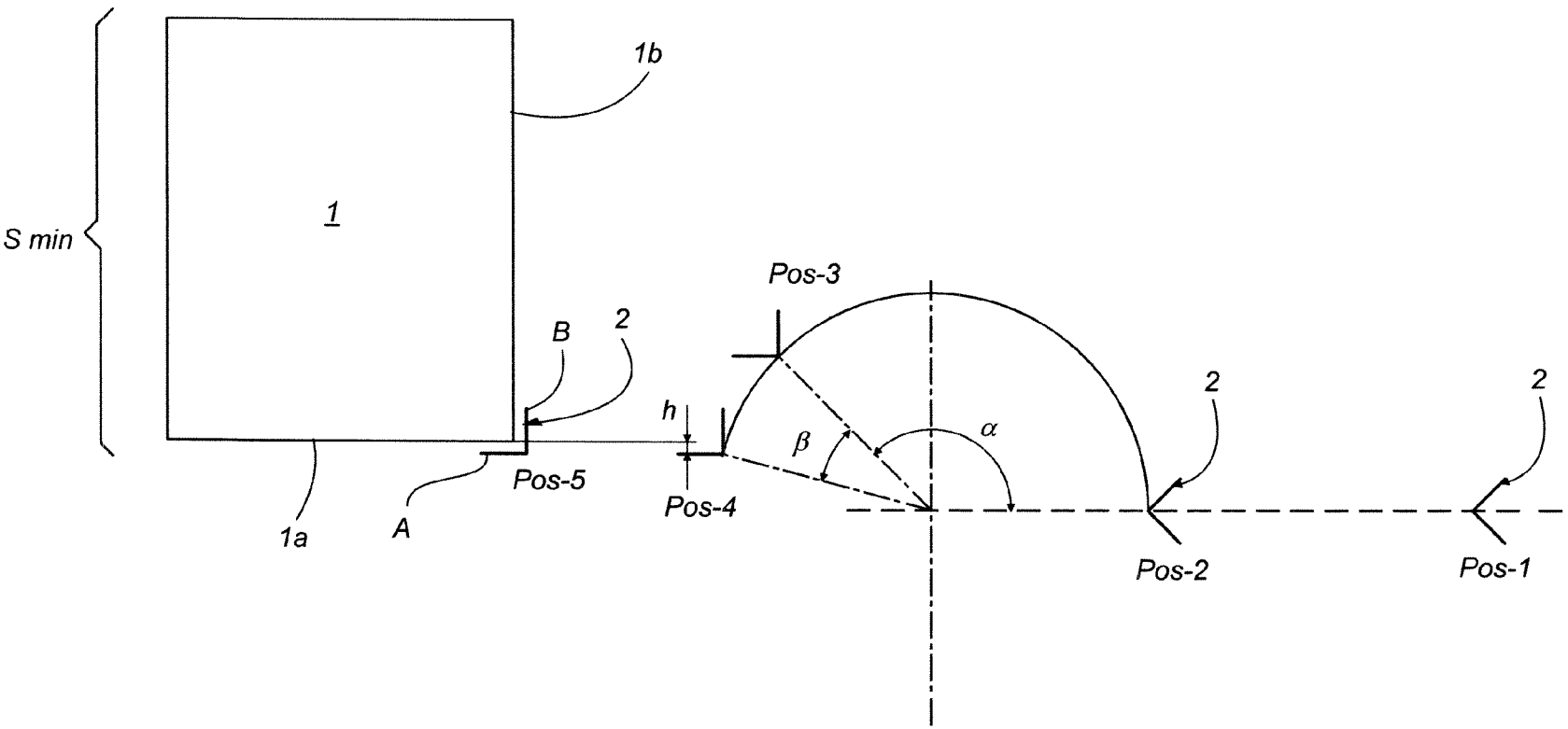
FIG. 4 schematically illustrates the succession of positions adopted by a corner element applied to a load by an apparatus according to the invention.

During operation, as illustrated in FIG. 4, the arm 5 is initially located at position Pos1, also shown in FIG. 3*a*, aligned along the rail and with the suction cups 43 holding the outermost corner element 2 in the magazine 3.

From this position, the arm 5, driven by the motor 7, moves to a position Pos2 for extracting the corner element 2 from the magazine 3 which is the position where the transfer of the corner element actually starts.

After this, the arm 5 rotates through an angle $\alpha$ (135° in the embodiment being described), where the section P1 of the cam profile is neutral, thus bringing the angular position of the corner element 2 to the position Pos3 with its sides parallel with the corresponding sides of the load 1 to be protected.

Advantageously, at the position Pos3 the unit 4 is within the minimum size Smin of the smallest pallet load 1 to be protected, so that the corner element 2 can be applied to this or larger loads.

From the position Pos3, the arm 5 continues to rotate with the corner element 2 maintaining its absolute angular position thanks to the cam-driven compensation mechanism described above. Rotation is stopped when the sensors of the unit 4, consisting preferably of photocells 45, detect the first side 1*a* substantially aligned with the corresponding side A of the corner element 2, that is to say, when the rotation $\beta$ of the arm 5 brings the side A of the corner element 2 to a level such that there is a predetermined clearance h between it and the corresponding side 1*a*.

In a preferred embodiment of the invention, especially for applying corner elements to large loads, the arm 5, as it rotates, also moves back along the rail 8 so as to prevent the corner element 2 from striking the side 1*b* of the load 1.

From this point of alignment (Pos4) the arm 5 is moved towards the load 1 until the sensors 45 installed on the unit 4, for example on the profile 44, detect that the second side B of the corner element 2 is close to the second side 1*b* of the load 1. At this point (Pos5) the arm 5 has positioned the corner element 2 at the corner of the load 1 to be protected.

With reference to the machine illustrated in FIG. 1, when the apparatus according to the invention is in this position, or even slightly before this, the wrapping means (not illustrated in detail) start placing the plastic wrapping film around the corner elements, moving from the top down, thus securing the corner elements against the load 1.

The arm (or arms) 5 can thus return to the starting position, waiting for the next load.

The invention also relates to a method, described below, for applying corner elements to palletized loads, and comprising the following steps:

extracting a protective corner element 2 from a magazine from a storage position Pos1 to an extracted position Pos2;

transferring the corner element 2 by rotating it through a defined angle from the extracted position Pos2 to a position Pos4 where at least one side of the corner element 2 is aligned with a corresponding side of the load 1;

transferring the corner element 2 from the alignment position Pos4 to a position Pos5 where it is close to the load 1.

According to the invention, the step of transferring the corner element from the extracted position Pos2 to the alignment position Pos4 comprises a step of compensating the angular position adopted by the corner element 2 relative to the load 1 so as to keep the sides of the corner element parallel with the sides of the load.

Preferably, the step of transferring the corner element from the extracted position Pos2 to the alignment position Pos4 comprises a translational movement of the corner element away from the load 1 so as to occupy less space and thus prevent the corner element 2 from striking the load 1 during the rotational transfer movement.

Figure 5:
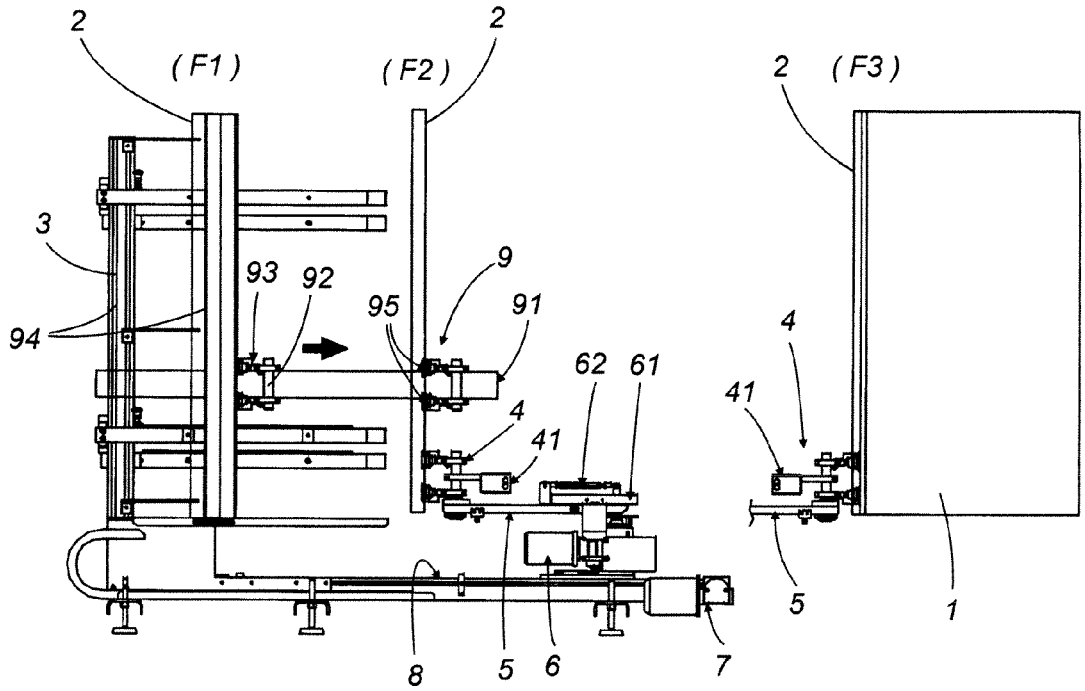
FIG. 5 illustrates the apparatus according to the invention in another embodiment, equipped with a unit for extracting the corner elements from a magazine, and shows the successive steps in its operation, from the extraction of a corner element from the magazine to its application to a load.
Figure 6:
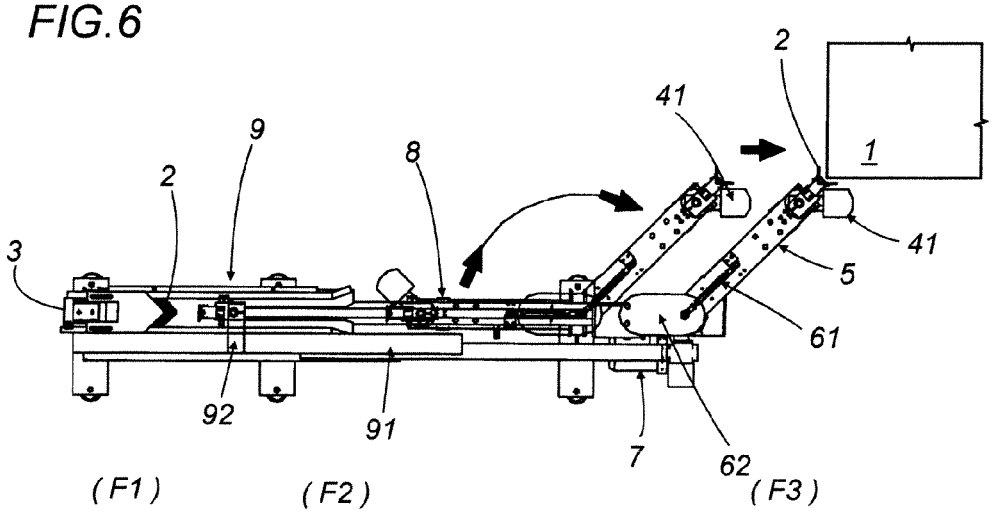
FIG. 6 is a top view of the apparatus of FIG. 5.

The invention will now be described with reference to FIGS. 5 and 6 illustrating an apparatus which applies corner elements to a palletized load 1 and which is equipped with a unit 9 for extracting the corner elements 2 from a magazine 3.

It will be understood that the extraction unit may be used in conjunction with the different embodiments of the apparatus described above or as an independent, self-contained unit for extracting corner elements 2 from a generic magazine 3 in which the corner elements 2 are stored in a vertical position, side by side in packs.

The unit 9 comprises a gripping unit 93, equipped with suction cups 95 which are in turn mounted on a vertical mounting element 92 (there being preferably four suction cups of customary type—arranged in two rows although other arrangements are possible—for transporting corner elements).

The gripping unit 93 can slide in both directions along a horizontal beam 91 supported by two side uprights 94 of the magazine 3, and is driven by a motor unit which is of known type and therefore not described in any detail.

During the initial step F1 in its operation, the unit 93 is inside the magazine 3 with the suction cups 95 holding the outermost corner element 2.

During the next step F2, the unit 93 slides along the beam 91 in the direction indicated by the arrow in FIG. 5, transporting the corner element 2 to an extracted end of stroke position where the corner element is outside the magazine 3.

During this step, as illustrated schematically in FIG. 5, the gripping unit 4 of the transfer arm 5 is located at the point of arrival of the unit 9 and is ready to receive the corner element 2, which can then be transferred to the load 1.

From this point on, the operation of the apparatus is the same as that described above, with the arm 5 rotating until the sides of the corner element are aligned with the sides of the load 1 and then moving forward until the corner element comes into contact with a corner of the load (step F3 in FIG. 5).

In the meantime, the extraction unit 93 returns to its initial position to pick up another corner element from the magazine, after which the above steps are repeated.

This embodiment advantageously achieves high production speeds since the extraction step is performed by the unit 9 at the same time as the gripping unit 4 of the transfer arm 5 moves back towards the magazine 3 immediately after applying the corner element 2 to the load 1.

Figure 7A:
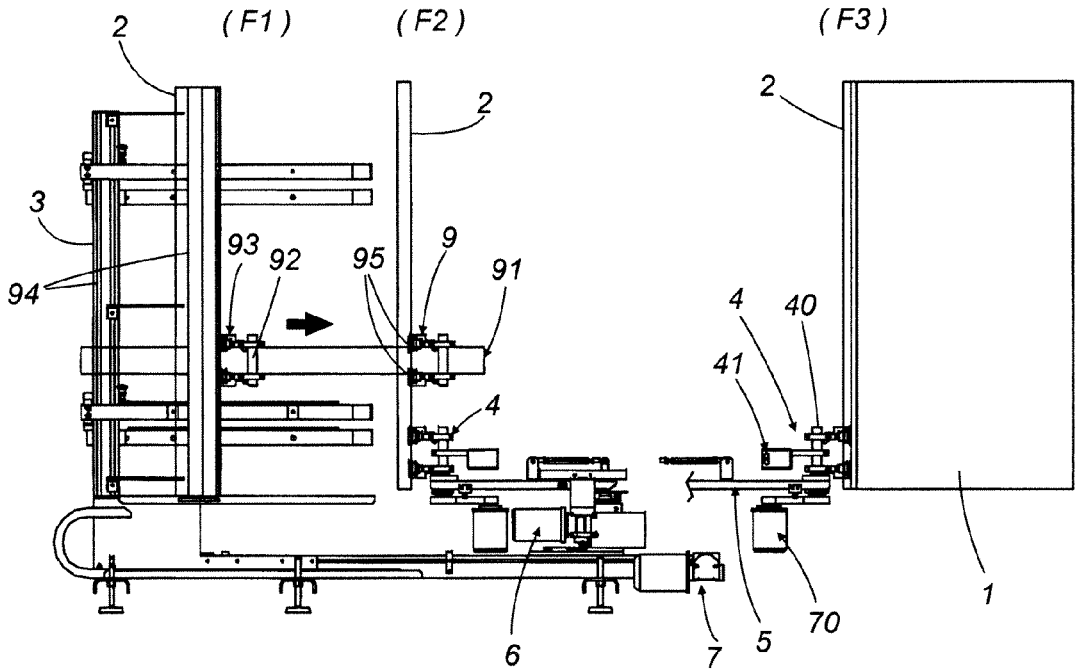
FIGS. 7*a* and 7*b* are, respectively, a side view and a top view of another embodiment of a corner element transfer arm in an apparatus according to FIGS. 5 and 6.
Figure 7B:
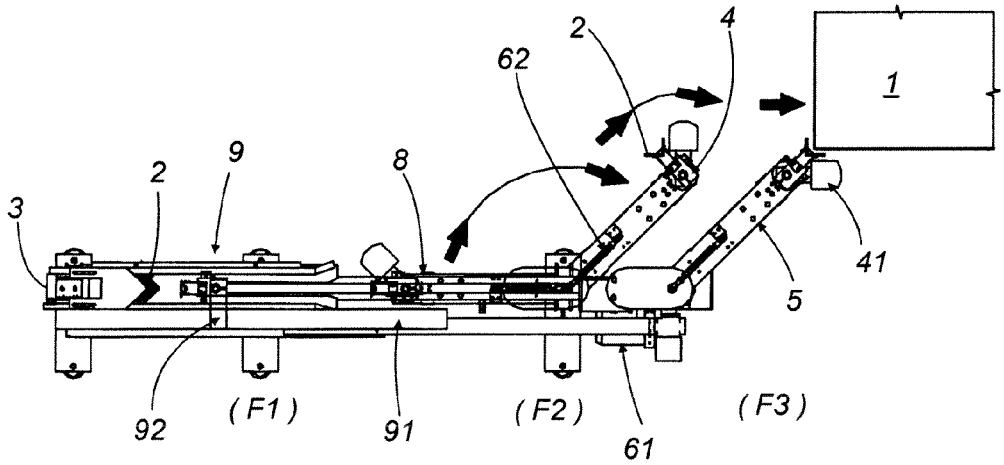

FIGS. 7*a* and 7*b* show another embodiment of the transfer arm 5, used in conjunction with an extraction unit 9 described above with reference to FIGS. 5 and 6.

It will be understood, however, that the arm 5 can also be used independently of the unit 9.

For clarity, parts that have already been described have the same reference numbers in FIGS. 7*a* and 7*b*.

In this embodiment, the arm 5 has another motor unit 70 which drives the gripping unit 4 rotationally relative to the arm 5.

More specifically, the unit 4 can rotate independently since it is mounted on a pin 40 that is driven by the motor 70.

In the embodiment described, the motor is positioned on the side of the arm 5 opposite the gripping unit 4 but might be mounted at other positions without departing from the scope of the invention.

Advantageously, in this embodiment, the motion of the unit 4 and of the corner element 2 transported by the unit 4 may be independent of the rotation of the arm 5.

FIG. 7*b* schematically illustrates a possible succession of steps comprising a further step F4 of rotating the unit 4 from a position where rotation starts (which may or may not coincide with the position of extracting the corner element from the magazine 3) to an end position where the corner element 2 is applied to the load 1.

The motor 70 which rotationally drives the unit 4 may be controlled and programmed in different ways, even during the return stroke towards the magazine 3, so that, for example, corner element magazines oriented differently with respect to the arm 5 might be used, with different programming of the rotation necessary to position the sides of the corner element 2 so they are parallel with the sides of a load 1 of any size provided it is within the range of the arm 5.

The invention described has evident industrial applications and may be subject to modifications and variations without thereby departing from the scope of the inventive concept. Moreover, all the details of the invention may be substituted by technically equivalent elements.

The invention claimed is:

1. A method for applying protective corner elements held by a transfer arm to palletized loads having at least one side defining an alignment direction, comprising a step of transferring a corner element from an initial position to a position where the corner element is close to the load, wherein said transfer step comprises:

a transfer of the corner element from the initial position to an intermediate position where at least one side of the corner element is aligned with one side of the load, wherein said transfer of the corner element comprises a rotation movement of the transfer arm around an axis; and a rectilinear transfer of the corner element in the alignment direction from the intermediate position to the position close to the load;

wherein the transfer of the corner element from the initial position to the intermediate position also comprises a translation movement of the transfer arm away from the load as the transfer arm rotates about said axis.

2. The method according to claim 1, wherein the rotation movement of the corner element about said axis further comprises a step of compensating the angular position of the corner element relative to the transfer arm so as to keep sides of the corner element parallel with corresponding sides of the load.

3. The method according to claim 1, wherein the step of transferring the corner element comprises a preliminary step of extracting the corner element from a storage position to an extracted position.

4. The method according to claim 3, comprising a step of extracting a corner element from a magazine by means of an extraction unit.

5. The method according to claim 4, wherein the extraction step is performed by an extraction unit which transports the corner element to an extracted position where it is outside the magazine and where the extraction unit releases the corner element which is picked up by a gripping unit and transferred to the load.

6. The method according to claim 5, wherein the extraction step is performed at the same time as a return step during which the gripping unit, after applying the corner element to the load, moves back to pick up the next corner element.

7. The method according to claim 1, wherein the rotation movement of the corner element comprises a step of transferring the corner element to a position where its sides are parallel with corresponding sides of the load and where the corner element is within the minimum size of the load to be protected, so that the corner element can be applied to minimum size or larger loads.

8. The method according to claim 1, comprising a step of independently rotating the unit from an arbitrary position to a position where the corner element is applied to the load.

9. A method for applying protective corner elements having first and second sides to corner edges of a palletized load having first and second sides, comprising the steps of:

transferring the corner element by rotational movement about an axis from an initial position to an alignment position where at least one side of the corner element is not proximate and is aligned with one side of the load;

transferring the corner element by a translational movement from said alignment position to a position where the corner element is close to the load, wherein the corner element is supported by a gripping unit pivotally mounted on a rotating arm, the step of transferring the corner element from the initial position to the alignment position comprising a step of:

transferring the corner element by rotation of the rotating arm in a first rotational direction from the initial position to a position where the sides of the corner element are parallel with the sides of the load, and transferring the corner element from the position where the sides of the corner element are parallel with the sides of the load to the alignment position by rotation of the rotating arm in said first rotational direction and simultaneously by rotation of the gripping unit in a second rotational direction opposite to the first rotational direction of the arm in order to keep the corner element sides parallel with the sides of the load.

10. The method according to claim 9 wherein the step of transferring the corner element from the initial position to the alignment position comprises a simultaneous translational movement of the corner element away from the load.

11. The method according to claim 9, wherein said position where the sides of the corner element are parallel with the sides of the load is within a minimum size of the load to be protected, so that the corner element can be applied to loads having said minimum size or larger by further rotation of the rotating arm.

12. A method for applying protective corner elements to palletized loads having sides parallel to a longitudinal direction of movement of the load and having a size equal or larger than a minimum size, comprising:

providing a rotating arm supporting at least a corner element;

transferring a corner element by rotational movement of the arm from an initial position to a parallel position of the corner element where the sides of the corner element are parallel with the sides of the load, wherein in said parallel position the corner element is placed within a region which is going to be occupied by a load having said minimum size during said longitudinal movement of the load;

transferring the corner element from said parallel position to a proximity position where the corner element is close to a corner of the load.

13. The Method according to claim 12, wherein said step of transferring the corner element from the parallel position to the proximity position comprises a step of transferring the corner element from the parallel position to an alignment position not proximate to the load, where at least one side of the corner element is aligned with one side of the load and then transferring the corner element from said alignment position to the proximate position by translation of a carriage supporting the rotating arm.

14. The Method according to claim 12, wherein at least one of said steps of transferring a corner element from the initial position to the parallel position and from the parallel position to the proximity position comprises a displacement of the corner element away from the load.

15. The Method according to claim 12, comprising a step of extracting a corner element from a magazine by means of an extraction unit.

* * * * *